US008467554B2

(12) United States Patent
Giese et al.

(10) Patent No.: US 8,467,554 B2
(45) Date of Patent: Jun. 18, 2013

(54) METHOD, HEARING DEVICE AND CONFIGURATION FOR CALIBRATING AN ACOUSTIC TUNING SYSTEM

(75) Inventors: Ulrich Giese, Fuerth (DE); Matthias Latzel, Eggolsheim (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 317 days.

(21) Appl. No.: 12/943,432

(22) Filed: Nov. 10, 2010

(65) Prior Publication Data

US 2011/0110545 A1 May 12, 2011

(30) Foreign Application Priority Data

Nov. 10, 2009 (DE) ..... 10 2009 052 575

(51) Int. Cl.
*H04R 25/00* (2006.01)

(52) U.S. Cl.
USPC ..... 381/312; 381/315; 381/317

(58) Field of Classification Search
USPC ..... 381/312, 318, 23.1, 60, 314, 315, 381/317
See application file for complete search history.

(56) References Cited

U.S. PATENT DOCUMENTS 6,366,863 B1 * 4/2002 Bye et al. ..... 702/57
2006/0188106 A1 * 8/2006 Weidner ..... 381/60

FOREIGN PATENT DOCUMENTS

DE 10115430 C1 6/2002
DE 102005008318 A1 8/2006

* cited by examiner

*Primary Examiner* — Curtis Kuntz
*Assistant Examiner* — Amir Etesam
(74) *Attorney, Agent, or Firm* — Laurence A. Greenberg; Werner H. Stemer; Ralph E. Locher

(57) ABSTRACT

A method for setting a device for presenting sound specimens for the individual tuning of a hearing device to be worn on the body of a hearing device wearer. The method includes providing and presenting a noise signal by the device, receiving the presented noise signal by at least one microphone of the hearing device, comparing the received noise signal or a signal derived therefrom with a reference signal stored in the hearing device, and emitting a status signal by the hearing device in dependence on the comparison. In this manner, simple and precise setting of the device for emitting sound specimens for calibration purposes occurs.

12 Claims, 3 Drawing Sheets

METHOD, HEARING DEVICE AND CONFIGURATION FOR CALIBRATING AN ACOUSTIC TUNING SYSTEM

CROSS-REFERENCE TO RELATED APPLICATION

This application claims the priority, under 35 U.S.C. §119, of German application DE 10 2009 052 575.0, filed Nov. 10, 2009; the prior application is herewith incorporated by reference in its entirety.

BACKGROUND OF THE INVENTION

Field of the Invention

The invention relates to a method and a hearing device for calibrating an acoustic tuning system for emitting sound specimens and an associated arrangement.

Hearing devices are wearable hearing apparatuses used to assist the hard of hearing. In order to accommodate the numerous individual requirements, different configurations of hearing devices are provided, such as behind-the-ear hearing devices, hearing devices with an external earpiece and in-the-ear hearing devices, for example also concha hearing devices or canal hearing devices. The hearing devices cited by way of example are worn on the outer ear or in the auditory canal. Bone conduction hearing aids, implantable or vibrotactile hearing aids are also commercially available. With these the damaged hearing is stimulated either mechanically or electrically.

In principle hearing devices have as their essential components an input transducer, an amplifier and an output transducer. The input transducer is generally a sound receiver, e.g. a microphone, and/or an electromagnetic receiver, e.g. an induction coil. The output transducer is mostly realized as an electro-acoustic transducer, e.g. a miniature loudspeaker, or as an electromechanical transducer, e.g. a bone conduction earpiece. The amplifier is generally integrated in a signal processing unit. This basic structure is shown in FIG. 1 using the example of a behind-the-ear hearing device 1. A hearing device housing 2 to be worn behind the ear has built into it one or more microphones 3 for receiving the sound from the environment. A signal processing unit 4 which is also integrated in the hearing device housing 2 processes the microphone signals and amplifies them. The output signal from the signal processing unit 4 is transmitted to a loudspeaker or earpiece 5 which outputs an acoustic signal. The sound is transmitted to the hearing device wearer's eardrum, where appropriate by way of a non-illustrated sound tube which is fixed in the auditory canal by an otoplastic. The hearing device 1 and in particular the signal processing unit 4 are supplied with power by a battery 6 which is also integrated in the hearing device housing 2.

A hearing device is generally tuned for an individual in a tuning booth. In this process the individual wearing the hearing device in the tuning booth is provided with sound specimens from a signal source, for example a CD or tape player. These sound specimens simulate, inter alia, critical situations for the hearing device wearer in order to enable the tuning of the hearing device to be optimized so that the sound from the hearing device is acceptable also in such critical situations. During tuning parameters relating to the signal processing in the hearing aid device are set individually. These parameters relate for example to signal transmission behavior, amplification, compression or settings for certain filters or algorithms in the hearing device, e.g. relating to interference noise reduction, speech enhancement or feedback suppression.

To optimize these parameters and settings the sound specimens presented have to match corresponding realistic situations as closely as possible. It is also necessary to know the characteristic values of a presented sound specimen, e.g. frequency, level, dynamic range, phase relationship, etc. at the location of the individual's ear as precisely as possible. These characteristic values deviate due to a number of factors from the ideal characteristics of the sound specimen. These factors include for example distortions caused by the tuning system, e.g. during signal generation, signal storage, signal processing, signal amplification or the playing back of the signal by way of a loudspeaker system. Furthermore reflections off the walls of the tuning booth can cause distortions, or the position of the hearing device wearer in the sound field may deviate from the ideal position, etc. Such distortions ultimately impact on the determined parameters for setting the hearing device so that these deviate from the optimum parameters and settings.

In order substantially to eliminate the abovementioned negative influencing factors, it is necessary to know the characteristic values of the sound specimen presented at the location of the hearing device as precisely as possible. Therefore the tuning system is first calibrated at the start of tuning. To this end special calibration signals are emitted by way of the loudspeaker system. A special measurement probe (e.g. probe microphone) is used to capture and evaluate the calibration signal at the location of the hearing device. This allows signal distortions to be identified and substantially eliminated by setting the tuning system correspondingly.

The procedure described above is complex and time-consuming and has the further disadvantage that in order to achieve an optimum result it has to be performed afresh for every sound specimen and every change in the position of the hearing device wearer in the sound field.

German patent DE 101 15 430 C1 therefore discloses a method for individually tuning a hearing device that can be worn on the body to suit a hearing device wearer, the method not requiring calibration. To this end a sound specimen with predeterminable signal characteristic values is presented to the hearing device wearer by a tuning system. The sound specimen is received by at least one microphone of the hearing device and transmitted back to the tuning system either directly or where necessary after signal processing. It is possible from the comparison of the predetermined signal with the signal actually measured at the location of the hearing device wearer to identify transmission errors of the tuning system and to equalize them continuously during tuning. Calibration of the tuning system at the start of a tuning session is therefore superfluous.

Published, non-prosecuted German patent application DE 10 2005 008 315 A1 discloses a simplified method for calibrating a hearing device in respect of a current feedback path. To this end a hearing device is provided including a measuring instrument for measuring a feedback path and a control device to enable the wearer to operate the hearing device. The control device allows a measuring cycle to be initiated to determine at least one characteristic of the feedback path. This allows the hearing aid wearer him/herself to calibrate his/her system in respect of the feedback path.

SUMMARY OF THE INVENTION

It is accordingly an object of the invention to provide a method, a hearing device and a configuration for calibrating an acoustic tuning system which overcome the above-mentioned disadvantages of the prior art methods and devices of this general type. More specifically, the present invention simplifies the calibration of a tuning system for the presentation of sound specimens for individual tuning of a hearing device.

The invention recites a method for setting a device for presenting sound specimens for the individual tuning of a hearing device that can be worn on the body of a hearing device wearer. The method includes the steps of providing and presenting a noise signal by the device, receiving the presented noise signal by at least one microphone of the hearing device, comparing the received noise signal or a signal derived therefrom with a reference signal stored in the hearing device, and emitting a status signal by the hearing device in dependence on the comparison.

The invention provides the basis for the simple and precise setting of the device for emitting sound specimens for calibration purposes without additional microphones. The spatial position of a hearing device wearer is also taken into account. Calibration takes place just once at the start of a tuning session and generally does not have to be repeated as long as the hearing device wearer does not change position.

In a development of the invention the status signal can be emitted acoustically by an earpiece of the hearing device. It can be evaluated by the hearing device wearer so that calibration can be performed by the hearing device wearer him/herself.

In a further embodiment, the method can have the following additional steps of evaluating the status signal, setting a parameter of the device in dependence on the evaluation, and emitting a sound specimen by the device. This has the advantage that the sound specimen is emitted already calibrated.

Evaluation of the status signal can also be performed in the device. This allows automatic calibration.

In a development of the invention the comparison of the received noise signal or the signal derived therefrom with the reference signal can include the comparison of the sound level of the received noise signal or the signal derived therefrom with the level of the reference signal. The advantages of this are that evaluation is simple and the volume level is taken into account.

In a further embodiment the parameter of the device can be the volume of the sound specimen provided by the device.

The signal received by the microphone can also be broken down in the hearing device into a multiplicity of frequency bands and the comparison of the received noise signal or the signal derived therefrom with the reference signal can be performed in a frequency band-related manner.

The invention also relates to a hearing device for calibrating a device for presenting sound specimens. The hearing device contains at least one microphone for receiving a noise signal presented by the device, a signal comparison unit for comparing the received noise signal or a signal derived therefrom with a reference signal stored in the hearing device, and a status signal emitting unit for emitting a status signal in dependence on the comparison.

In a development of the hearing device the status signal can be an acoustic signal that can be emitted by an earpiece of the hearing device.

In a further embodiment of the hearing device the signal comparison unit can compare the sound level of the received noise signal or the signal derived therefrom with the level of the reference signal.

The invention also relates to a configuration having a device for presenting sound specimens and having at least one loudspeaker for emitting the sound specimens to a hearing device. The configuration contains an inventive hearing device and a noise signal unit in a device for providing and presenting the noise signal.

The configuration can also include an evaluation unit in the device for evaluating the status signal and a setting unit in the device for setting a parameter of the device in dependence on the evaluation.

In a development of the configuration the parameter of the device can be a volume of the sound specimen provided by the device.

Other features which are considered as characteristic for the invention are set forth in the appended claims.

Although the invention is illustrated and described herein as embodied in a method, a hearing device and a configuration for calibrating an acoustic tuning system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
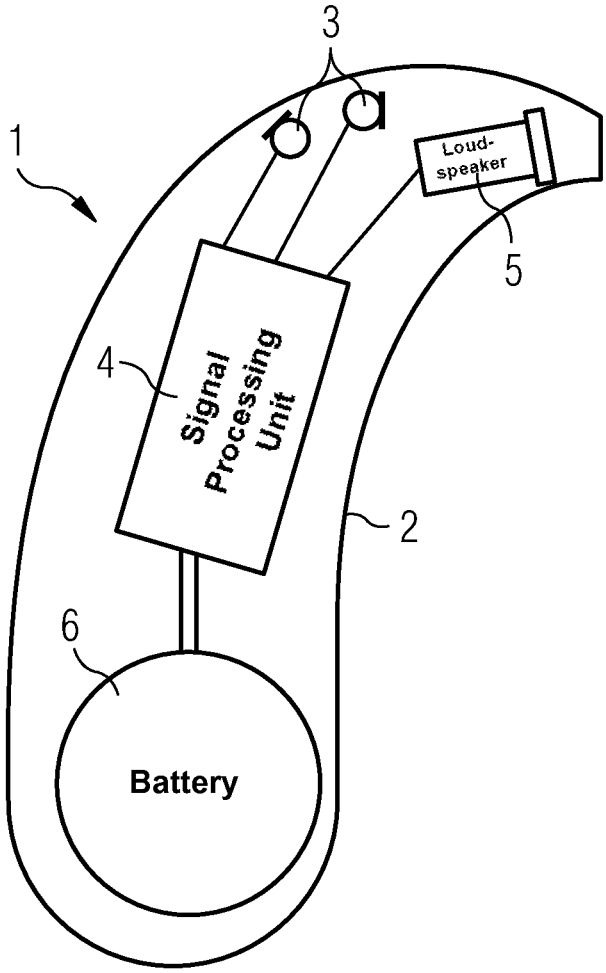
FIG. 1 PRIOR ART
FIG. 1 is an illustration showing a hearing device according to the prior art.
Figure 2:
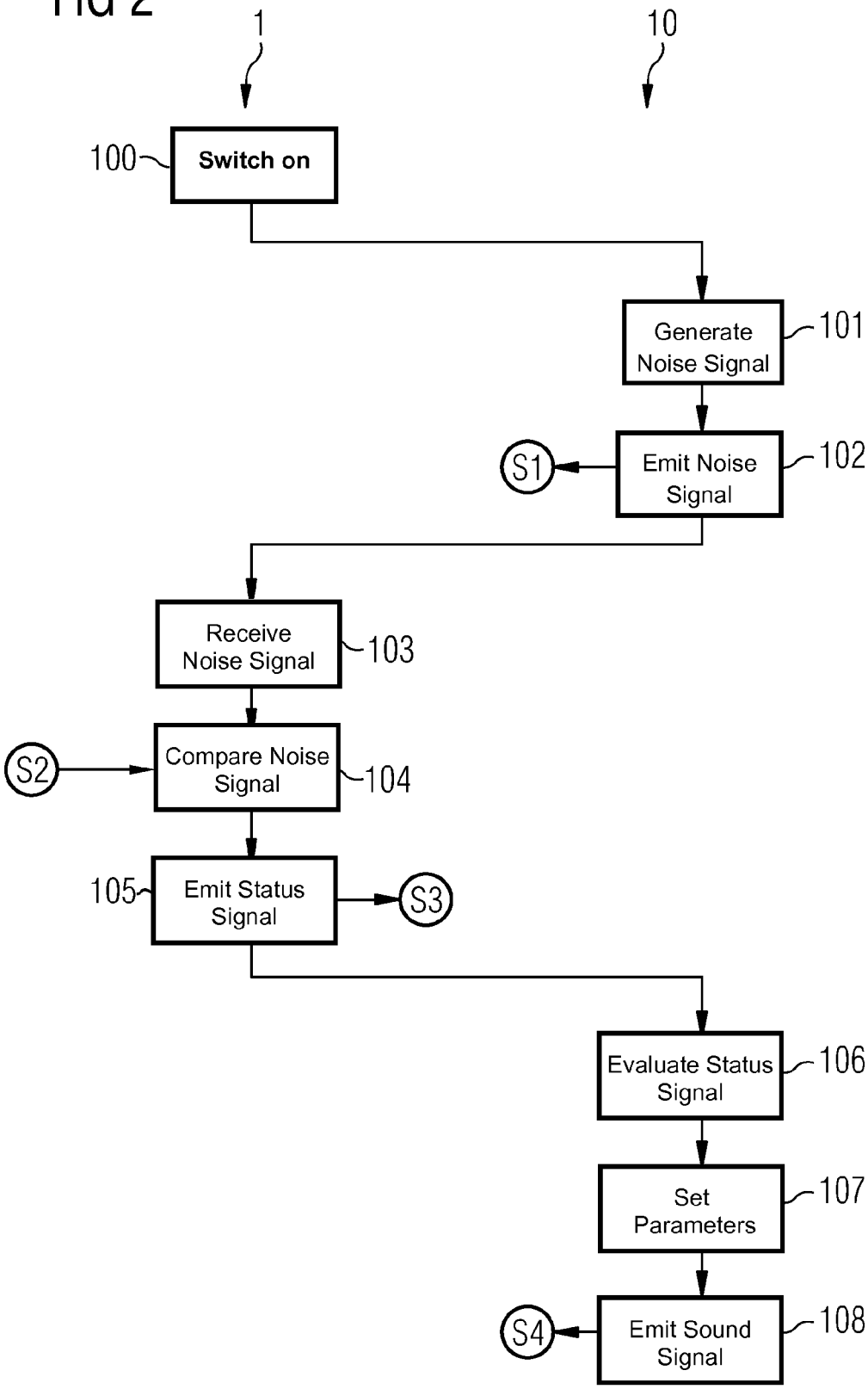
FIG. 2 is a flow diagram for illustrating a method for calibrating an acoustic tuning system according to the invention.
Figure 3:
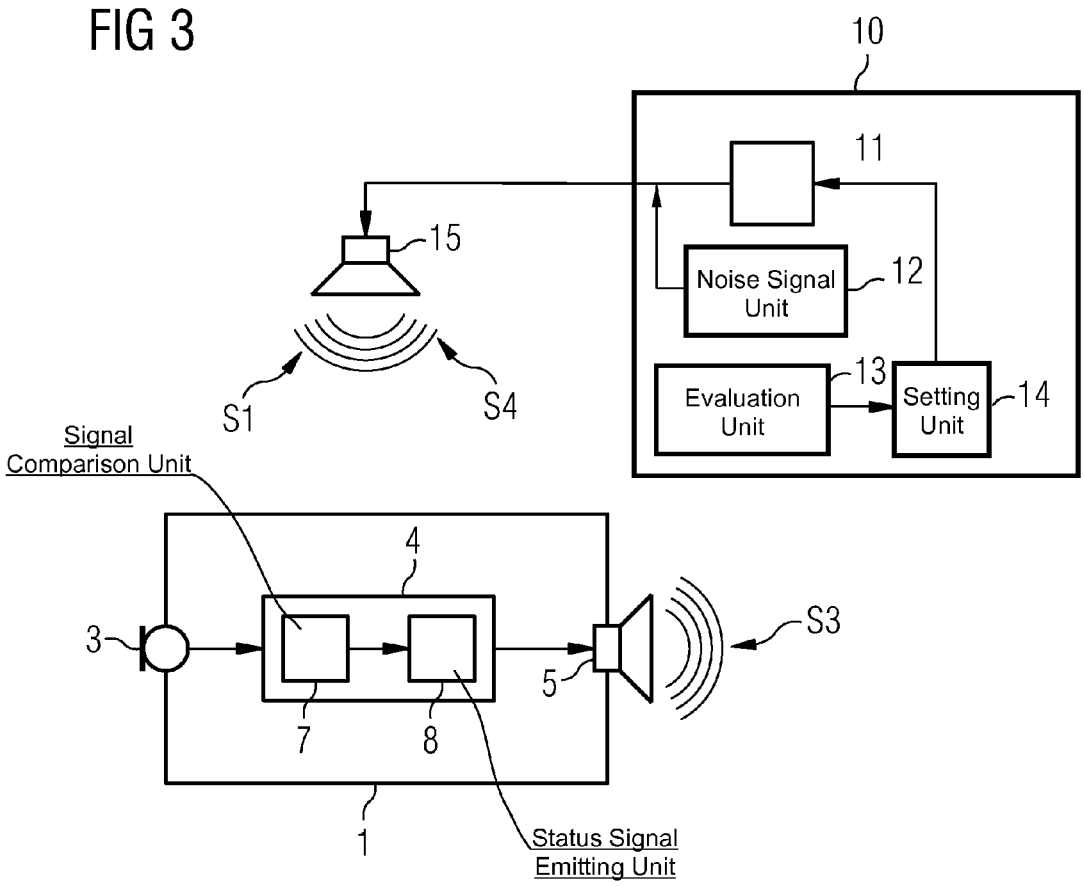
FIG. 3 is a block diagram of an acoustic tuning system according to the invention.

Referring now to the figures of the drawing in detail and first, particularly, to FIGS. 2 and 3 thereof, there is shown a flow diagram of an inventive method for calibrating an acoustic tuning system. The acoustic tuning system contains a device or means 10 and a loudspeaker 15 for presenting sound specimens S4 which can be used to fine-tune a hearing device 1. To that end it is aimed to ensure that precisely defined sound levels arrive at the ear of a wearer of the hearing device 1. The acoustic tuning system must therefore be calibrated. The sound level at the ear of the hearing device wearer is also dependent on the wearer's seating position in the booth and varies with the position.

According to the invention, therefore, in a first step 100 the hearing device 1 worn by the hearing device wearer is switched on. In the following step 101 the device 10 provides a noise signal 51, what is known as a calibration noise signal. In step 102 the noise signal 51 is emitted by the device 10 by way of the loudspeaker 15 and presented to the hearing device 1. The hearing device 1 receives the presented noise signal 51 in step 103. In the following step 104 the received noise signal 51 or a signal derived therefrom is compared in the hearing device 1 with a reference signal S2 stored in the hearing device 1. For example, the sound level of the received noise signal 51 is determined in the hearing device 1 by level measurement and compared with a reference level or setpoint level.

In step 105 an acoustic status signal S3 is emitted by the hearing device 1 to the hearing device wearer in dependence on a result of the comparison—sound level corresponds roughly to reference level, sound level too low or sound level too high. For example, a long tone signals that the calibration is correct, two short tones signal that the sound level is too low, and four short tones signal that the sound level is too high.

In step 106 the hearing device wearer evaluates the status signal S3 and in step 107 sets a parameter of the device 10, in the instance described the volume of the sound specimen S4 to be emitted, according to the status signal S2 heard. In the final step 108 the device 10 emits the selected sound specimen S4 at the newly set volume by way of the loudspeaker 15.

Alternatively the status signal S3 can also indicate the exact value of the volume to be set for the device 10 in the form of spoken text.

In a further embodiment the status signal S3 is not output acoustically but is transmitted wirelessly directly to the device 10, where it is evaluated. The device 10 then sets itself automatically to the required volume and is thus calibrated for the current spatial position of the hearing device wearer.

FIG. 3 shows a block diagram of an inventive calibration arrangement having an acoustic tuning system containing the device 10 for presenting sound specimens S4 and a loudspeaker 15 for emitting the sound specimens S4. The acoustic tuning system is used to fine-tune hearing device parameters of the hearing device 1 with the aid of the sound specimens S4. For repeatable and usable results the tuning system must be calibrated. In other words, for example, the volume of the sound specimens S4 is adjusted according to the position of the wearer of the hearing device 1 in the booth. Calibration is performed with the aid of the noise signal S1.

To this end the device 10 includes a noise signal unit 12 which emits a noise signal S1 to the hearing device 1 by way of the loudspeaker 15. A microphone 3 of the hearing device 1 receives the noise signal S1 and emits it to a signal processing unit 4 of the hearing device 1. The level of the noise signal S1 is compared with the level of a reference signal S2 in a signal comparison unit 7 of the signal processing unit 4. The result of the comparison is emitted to a status signal emitting unit 8 of the signal processing unit 4. According to the result this emits an electrical status signal S3 to an earpiece 5 of the hearing device 1, the earpiece 5 converting it into an acoustic status signal S3 and emitting it to the hearing device wearer. A setting unit 14 of the device 10 can be used by the hearing device wearer for example to change or adjust the volume of the sound specimens S4 to be emitted.

Alternatively the status signal S3 can be emitted wirelessly to an evaluation unit 13 of the device 10. The evaluation unit 13 evaluates the status signal S3 and emits the result to the setting unit 14, which automatically adjusts the volume of the sound specimens S4 to be emitted so that uniquely defined sound specimens S4 reach the hearing device 1.

In a development the noise signal S1 received by the microphone 3 can be broken down in the hearing device 1 into a multiplicity of frequency bands and the comparison of the received noise signal S1 or the signal derived therefrom with the reference signal S2 can be performed on a frequency band-related basis.

The invention claimed is:

1. A method for setting an external device for presenting sound specimens for an individual tuning of a hearing device to be worn on a body of a hearing device wearer, which comprises the steps of:

providing and presenting a noise signal by a loudspeaker of the external device;

receiving the noise signal by at least one microphone of the hearing device;

comparing the noise signal received or a signal derived therefrom with a reference signal stored in the hearing device;

emitting a status signal by the hearing device in dependence on a comparison;

evaluating the status signal;

setting a parameter of the external device in dependence on an evaluation; and emitting a sound specimen via the external device.

2. The method according to claim 1, which further comprises emitting the status signal acoustically by an earpiece of the hearing device.

3. The method according to claim 1, which further comprises performing an evaluation of the status signal in the external device.

4. The method according to claim 1, wherein a comparison of the noise signal received or the signal derived therefrom with the reference signal includes a comparison of a sound level of the noise signal received or the signal derived therefrom with a level of the reference signal.

5. The method according to claim 1, wherein the parameter of the external device is a volume of a sound specimen provided by the external device.

6. The method according to claim 1, which further comprises breaking down the noise signal received by the microphone in the hearing device into a multiplicity of frequency bands and the comparison of the noise signal received or the signal derived therefrom with the reference signal is performed on a frequency band-related basis.

7. A hearing device for calibrating an external device for providing sound specimens, the hearing device comprising:

at least one microphone for receiving a noise signal provided by a loudspeaker of the external device;

a signal comparison unit for comparing the noise signal received or a signal derived therefrom with a reference signal stored in the hearing device;

a status signal emitting unit for emitting a status signal in dependence on a comparison; and the external device evaluates the status signal, sets a parameter of the external device in dependence on an evaluation, and emits a sound specimen back to the hearing device.

8. The hearing device according to claim 7, further comprising an earpiece for emitting the status signal acoustically.

9. The hearing device according to claim 7, wherein said signal comparison unit compares a sound level of the noise signal received or the signal derived therefrom with a level of the reference signal.

10. A configuration, comprising:

a hearing device having at least one microphone for receiving a noise signal, a signal comparison unit for comparing the noise signal received or a signal derived therefrom with a reference signal stored in said hearing device, and a status signal emitting unit for emitting a status signal in dependence on a comparison; and a device for providing sound specimens, said device having at least one loudspeaker for emitting the sound specimens to said hearing device, and a noise signal unit for providing and presenting the noise signal to said hearing device, said device evaluates the status signal, sets a parameter of the device in dependence on an evaluation, and emits a sound specimen to said hearing device.

11. The configuration according to claim 10, wherein said device has an evaluation unit for evaluating the status signal, and a setting unit for setting the parameter of said device in dependence on an evaluation.

12. The configuration according to claim 11, wherein the parameter of said device is a volume of a sound specimen provided by said device.

* * * * *